US010269526B2

(12) United States Patent
Martinez et al.

(10) Patent No.: US 10,269,526 B2
(45) **Date of Patent: *Apr. 23, 2019**

(54) HALL CURRENT PLASMA SOURCE HAVING A CENTER-MOUNTED CATHODE OR A SURFACE-MOUNTED CATHODE

(71) Applicant: Colorado State University Research Foundation, Fort Collins, CO (US)

(72) Inventors: Rafael A. Martinez, Redmond, WA (US); John D. Williams, Fort Collins, CO (US); Joel A. Moritz, Jr., Fort Collins, CO (US); Casey C. Farnell, Fort Collins, CO (US)

(73) Assignee: Colorado State University Research Foundation, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/901,763

(22) Filed: Feb. 21, 2018

(65) Prior Publication Data

US 2018/0226217 A1 Aug. 9, 2018

Related U.S. Application Data

(63) Continuation of application No. 15/424,385, filed on Feb. 3, 2017, now Pat. No. 9,934,929.

(51) Int. Cl.
*H01J 27/14* (2006.01)
*F03H 1/00* (2006.01)

(52) U.S. Cl.
CPC ..... *H01J 27/146* (2013.01); *F03H 1/0075* (2013.01); *H01J 27/143* (2013.01)

(58) Field of Classification Search
CPC ..... H01J 27/146; F03H 1/0075
(Continued)

(56) References Cited

U.S. PATENT DOCUMENTS 5,847,493 A 12/1998 Yashnov
5,973,447 A 10/1999 Mahoney
(Continued)

OTHER PUBLICATIONS

International Search Report dated May 8, 2018 as received in Application No. PCT/US18/15609.
(Continued)

*Primary Examiner* — Dylan C White
(74) *Attorney, Agent, or Firm* — Maschoff Brennan; Paul G. Johnson

(57) ABSTRACT

A miniature Hall current plasma source apparatus having magnetic shielding of the walls from ionized plasma, an integrated discharge channel and gas distributor, an instant-start hollow cathode mounted to the plasma source, and an externally mounted keeper, is described. The apparatus offers advantages over existing other Hall current plasma sources having similar power levels, including: lower mass, longer lifetime, lower part count including fewer power supplies, and the ability to be continuously adjustable to lower average power levels using pulsed operation and adjustment of the pulse duty cycle. The Hall current plasma source can provide propulsion for small spacecraft that either do not have sufficient power to accommodate a propulsion system or do not have available volume to incorporate the larger propulsion systems currently available. The present low-power Hall current plasma source can be used to provide energetic ions to assist the deposition of thin films in plasma processing applications.

20 Claims, 5 Drawing Sheets

(58) Field of Classification Search
USPC ..... 315/111.41
See application file for complete search history.

(56) References Cited

U.S. PATENT DOCUMENTS

| | | | | |
|---|---|---|---|---|
| 6,068,962 | A | 5/2000 | Uetani | |
| 6,086,962 | A | 7/2000 | Mahoney | |
| 6,504,294 | B1 * | 1/2003 | Mahoney | C23C 16/26 313/359.1 |
| 8,125,155 | B2 | 2/2012 | Chistyakov | |
| 8,468,794 | B1 | 6/2013 | Patterson | |
| 9,305,733 | B2 | 4/2016 | Rand | |
| 9,934,929 | B1 * | 4/2018 | Martinez | H01J 27/146 |
| 2002/0008455 | A1 | 1/2002 | Fisch | |
| 2002/0163289 | A1 | 11/2002 | Kaufman | |
| 2006/0177599 | A1 * | 8/2006 | Madocks | C23C 14/32 427/569 |
| 2012/0311992 | A1 * | 12/2012 | Ozaki | F03H 1/0012 60/202 |
| 2014/0053531 | A1 | 2/2014 | Goebel | |
| 2014/0090357 | A1 * | 4/2014 | Zurbach | F03H 1/0075 60/202 |
| 2015/0020502 | A1 | 1/2015 | Larigaldie | |
| 2016/0207642 | A1 | 7/2016 | Longmier | |

OTHER PUBLICATIONS

Written Opinion of the International Searching Authority dated May 8, 2018 as received in Application No. PCT/US18/15609.

* cited by examiner

HALL CURRENT PLASMA SOURCE HAVING A CENTER-MOUNTED CATHODE OR A SURFACE-MOUNTED CATHODE

CROSS-REFERENCE TO RELATED APPLICATION

This application is a continuation application under 35 U.S.C. § 120 of U.S. patent application Ser. No. 15/424,385 filed Feb. 3, 2017 and titled HALL CURRENT PLASMA SOURCE HAVING A CENTER-MOUNTED OR A SURFACE-MOUNTED CATHODE, which issued as U.S. Pat. No. 9,934,929 on Apr. 3, 2018. U.S. Pat. No. 9,934,929 is incorporated herein by reference.

STATEMENT REGARDING FEDERAL RIGHTS

This invention was made with government support under Grant No. NNM15AA22P awarded by NASA Marshall Space Flight Center. The government has certain rights in the invention.

BACKGROUND

Hall current plasma sources when used on satellites are known as Hall thrusters. Such thrusters are plasma-source-based propulsion devices that have found application onboard spacecraft for station keeping, orbit transfers, and interplanetary missions. A combination of thrust efficiency, thrust density, and specific impulse makes Hall plasma sources effective for such varied space missions. Hall current plasma sources typically operate between 40% and 70% efficiency, with a thrust density of 1 mN/cm$^2$, and specific impulses of between 1000 s and 3000 s. Hall current plasma sources have been used for space missions since the 1970s, and American-designed Hall current plasma sources have been in use since 2006.

Hall current plasma sources generate thrust through the formation of an azimuthal electron current that interacts with an applied, quasi-radial magnetic field to produce an electromagnetic force. The plasma source operation results in ions being accelerated away from the source by an electric field that exists in the region of the applied, quasi-radial magnetic field. Used as a thruster, these sources provide an attractive combination of thrust and specific impulse for a variety of near-earth missions and, in many cases, they allow for significant reductions in propellant mass compared to conventional chemical propulsion. The range of thrust and specific impulse attainable by Hall current plasma sources makes them applicable to a variety of commercial and science missions. Many such missions, however, have only a limited amount of power and volume available. Similar constraints exist in plasma processing vacuum chambers where higher thin film deposition rates are desired, but are prevented due to the relatively low ion current provided by existing ion beam-based ion assist sources.

Small spacecraft (also known as Cubesats, nano-spacecraft, or microsatellites) are designed to fit within a very low mass budget and a constrained volume. To date, these small spacecraft vehicles have only been operated in Earth orbit, typically as "ride along" secondary payloads on other missions, but there is considerable interest in expanding the capability of these small spacecraft into lightweight, low cost missions performed throughout and beyond Low Earth Orbit. The lack of propulsion on Cubesats severely limits their capabilities and this means that the satellites have no useful control over their orbits once deployed. Limited power and surface area onboard these vehicles have resulted in primarily low specific impulse propulsion systems being considered, resulting in minimal orbit change capability and usability.

Although there are a number of small propulsion systems currently available, they only demonstrate a useful lifetime of less than approximately 1000 hours, which is insufficient if these devices are to be used as the primary propulsion system for deep space missions or long-term missions in near Earth orbits. In addition, these propulsion systems are typically heavy and can occupy a significant portion of the limited volume on these vehicles.

SUMMARY

Embodiments of the present invention overcome the disadvantages and limitations of the prior art by providing a Hall current plasma source having a surface-mounted, instant-start hollow cathode.

Another object of embodiments of the present invention is to provide a Hall current plasma source operated using a single electrical power supply.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

An embodiment of the Hall current plasma source hereof includes: a flat end plate having a first side and an opposing second side, and a channel therethrough between the first side and the second side; a cylindrical magnetizable core having a first end and a second end and a first axis, the first end being attached to the second side of said end plate, the core having an outer surface and a channel therethrough between the first end and the second end along the first axis aligned with the channel in the end plate; a first conducting wire coil wound around the outer surface of the core; a first cylindrical magnetizable screen having a second axis collinear with the first axis enclosing the first wire coil, the first cylindrical magnetic screen having an outer diameter; a hollow cathode discharge apparatus adapted to ionize a first chosen gas, comprising: a metal tube disposed in the channel of the magnetizable core, having a first end and a second end and an inside surface having a piece of low-work-function electride material mounted on a piece of graphite attached to the inner surface of the metal tube, the first end of the metal tube passing through the channel in the end plate and adapted to receive the first chosen gas; an electrical insulator attached to the first side of the end plate for supporting the metal tube and for electrically isolating the metal tube from both the end plate and the iron core; and a metallic keeper element having a hole therethrough for permitting the chosen gas from the metal tube to pass therethrough, the metallic keeper element being electrically isolated from the iron core and the metal tube; a second cylinder having a third axis collinear with the first axis, including: a second cylindrical magnetizable screen having a fourth axis collinear with the first axis, and an inner diameter which is larger than the outer diameter of the first cylindrical magnetic screen, forming an annular region therebetween; a second conducting wire coil disposed around the second magnetic screen; and a magnetizable outer cylinder having a fifth axis collinear with the first axis surrounding the second wire coil, the outer cylinder having a first end and a second end, the first end being mounted on the second side of the end plate; wherein the second end of the core and the second end of the outer cylinder are formed into circular pole pieces facing the annular region; at least one cylindrical anode band disposed in the annular region; an annular ion channel having an open end and a closed end formed in the annular region adapted to electrically isolate the first magnetic screen and the second magnetic screen from the at least one anode band; and a gas plenum adapted to receive a second chosen gas and for distributing the second gas into the ion channel.

Another embodiment of the Hall current plasma source hereof includes: a flat endplate having a first side and an opposing second side; a cylindrical magnetizable core having a first end and a second end and a first axis, the first end being attached to the second side of the end plate, said core having an outer surface; a first conducting wire coil wound around the outer surface of the core; a first cylindrical magnetizable screen having a second axis collinear with the first axis enclosing the first wire coil, the first cylindrical magnetic screen having an outer diameter; an externally mounted hollow cathode discharge apparatus adapted to ionize a first chosen gas; a second cylinder having a third axis collinear with the first axis, comprising: a second cylindrical magnetizable screen having a fourth axis collinear with the first axis, and an inner diameter which is larger than the outer diameter of the first cylindrical magnetic screen, forming an annular region therebetween; a second conducting wire coil disposed around the second magnetic screen; and a magnetizable outer cylinder having a fifth axis collinear with the first axis surrounding the second wire coil, the outer cylinder having a first end and a second end, the first end being mounted on the second side of the end plate; wherein the second end of the core and the second end of the outer cylinder are formed into circular pole pieces facing the annular region; at least one cylindrical anode band disposed in the annular region; an annular ion channel having an open end and a closed end formed in the annular region adapted to electrically isolate the first magnetic screen and the second magnetic screen from the at least one anode band; and a gas plenum adapted to receive a second chosen gas and for distributing the second gas into the ion channel.

Yet another embodiment of the Hall current plasma source hereof includes: a cylindrical magnetizable core having an outer surface and a first axis; a magnetizable cylinder having an outer surface and a second axis collinear with the first axis, surrounding the magnetizable core and forming an annular region therebetween; a first conducting wire coil wound around the outer surface of the core; a second conducting wire coil wound around the outer surface of the magnetizable cylinder, and in series electrical connection with the first conducting wire coil; at least one cylindrical anode band disposed in the annular region and in series electrical connection with the first conducting wire coil or the second conducting wire coil; a metallic keeper; a solenoid operated gas valve; a single electrical power supply having a positive terminal and a negative terminal; an electrical switch in series electrical connection with the first conducting wire coil or the second conducting wire coil, not in series electrical connection with the at least one anode band, said metallic keeper through a first resistive element, the solenoid of the gas valve, and in series electrical connection with the positive terminal of the single electrical power supply; a metal cathode in series electrical communication with a negative terminal of the single electrical power supply; and a capacitor in series electrical connection with a second resistive element together disposed in electrical connection across the positive terminal and the negative terminal of the single electrical power supply, wherein the series electrical connection between the capacitor and the resistor is in electrical communication with the switch.

Benefits and advantages of embodiments of the inventive concept include, but are not limited to, providing a Hall current plasma source having a surface-mounted, instant-start hollow cathode. An embodiment of the present Hall current plasma source is operable using a single electrical power source.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings:

FIG. 3A is a schematic representation of a side view of an embodiment of an external hollow cathode assembly that can be mounted onto an outer side surface of the cylindrical magnetic poles of the present Hall current plasma source, while

DESCRIPTION

Figure 1:
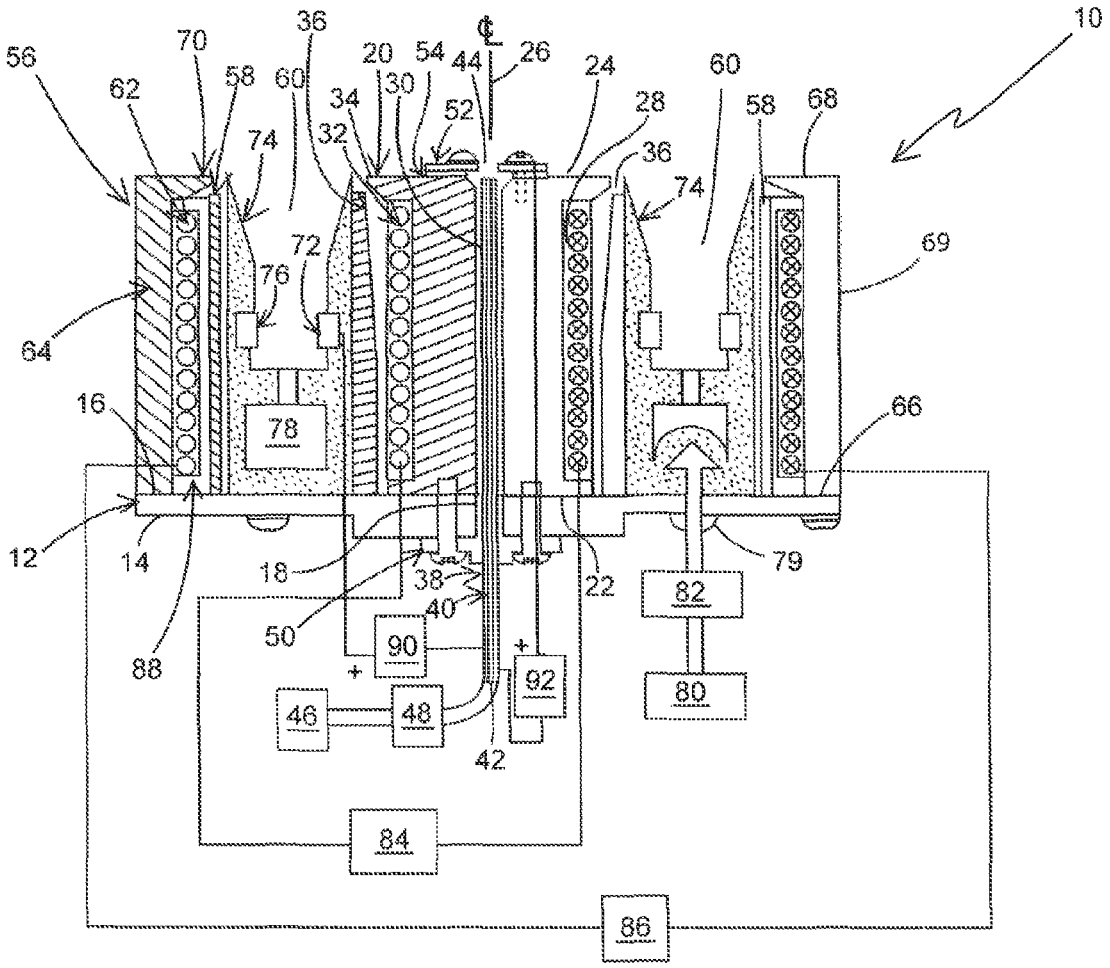
FIG. 1 is a schematic representation of a side view of an embodiment of the present Hall current plasma source, illustrating the center mounted cathode and the external keeper.

A long life miniature Hall current plasma source having a surface mounted hollow cathode is described. Hall current plasma sources when used on satellites are known as Hall thrusters. Hall current plasma sources create energetic ions in the 50 eV to 600 eV range at current density levels three to ten times higher than comparably sized gridded ion sources. As such, Hall current plasma sources may also serve as an ion assist source for thin film deposition systems.

Long life may be attributable to magnetically keeping electrons and ions away from the walls to reduce erosion thereof. In one embodiment of the present invention, the current plasma source includes a 1/16" o.d., heaterless, instant-start electride hollow cathode mounted along the plasma source centerline, a location demonstrated to improve performance in higher power Hall current plasma sources. Although an instant-start electride hollow cathode is used in the source, other instant and quickly starting cathodes can be utilized. For example, commercially available hollow cathodes provide instant starting using bare tantalum foil or similar inserts. The chosen cathode diameter disposed inside the inner core opening of the thruster permits proper thruster scaling to be maintained for the desired low power operating condition without saturating the magnetic material surrounding the cathode. Scaling for a Hall current plasma source is based partially on achieving a desired power and current density in the discharge channel at a given operating condition without saturating the magnetic material surrounding the cathode. As the scale of a Hall thruster is reduced to the sub-7 cm channel diameter regime, the increase in the thruster surface-to-volume ratio significantly contributes to the nonlinear scaling of miniature Hall current plasma sources.

Additionally, no scaling laws exist yet for magnetically shielded Hall current plasma sources; therefore, a proven scaling method for conventional Hall current plasma sources was applied with slight modifications to account for the larger surface-to-volume ratio and the effect of the magnetic shielding topography on the discharge channel wall profile (that is, as an example, the channel walls were chamfered to follow the field lines). Scaling relations relate the mean channel diameter, the channel width, the channel length, the discharge voltage, and the flow rate (or particle density). Data for these parameters for various thrusters were used to select these parameters for the present Hall current plasma source (See, e.g., Andrey A. Shaqayda, "On Scaling of Hall Effect Thrusters," IEEE Transactions on Plasma Science 43, No. 1 (2015): 12-28).

A Hall current plasma source can be designed with a larger discharge-channel width relative to the channel-outer diameter to improve performance and increase efficiency for a small Hall current plasma source with a high surface-to-volume ratio. In order to prevent saturation of the magnetic material in the inner core, it is advantageous to increase the inner core diameter, which requires that the source dimensions be expanded radially outward. This may lead to distortion of the desired magnetic field topography in the channel. A larger diameter Hall current plasma source will not perform well at low power (<400 W) due to poor electrical and propellant utilization efficiencies. The present Hall current plasma source retains efficiency at low power (beyond state-of-the-art thrusters) by making use of the efficiency improvement enabled by positioning the cathode along the centerline. In addition, 3D printing a plurality of small holes in a gas distributor, as opposed to drilling holes for flow passage, results in more uniform gas flow distribution around the channel that also contributes to higher performance.

Reference will now be made in detail to the present embodiments of the invention, examples of which are illustrated in the accompanying drawings. In the FIGURES, similar structures will be identified using identical reference characters. It will be understood that the FIGURES are for the purpose of describing particular embodiments of the invention and are not intended to limit the invention thereto. Turning now to FIG. 1, a schematic representation of a cross-section of an embodiment of the present Hall current plasma source, 10, is shown illustrating the use of a tubular hollow cathode with an external keeper. Flat end plate, 12, which may be constructed of a magnetizable material, has first side, 14, and second side, 16, and channel, 18, therethrough between the first side and the second side. Cylindrical magnetizable core, 20, having first end, 22, and second end, 24, and first axis, 26, first end 22 being attached to second side 16 of end plate 12, core 20 having outer surface, 28, and channel, 30, therethrough between first end 22 and second end 24 along first axis 26 aligned with channel 18 in end plate 12. First conducting wire coil, 32, is wound around the outer surface of core 20. Core 20 is shaped like a bobbin in order to facilitate the winding of coil 32, and to provide pole piece, 34, at one end. First cylindrical magnetizable screen, 36, has a second axis collinear with the first axis and encloses first wire coil 32, the magnetic screen having an outer diameter.

Hollow cathode discharge apparatus, 38, includes hollow metal tube, 40, having first end, 42, and second end, 44, and an inside surface with a low work function having, for example, a piece of $12CaO\text{-}7Al_2O_3$ electride material mounted on a piece of graphite attached to the inner surface of metal tube 40, not shown in FIG. 1. First end 42 passes through channel 18 in end plate 12 and receives a first chosen gas from gas source, 46, the flow of which is regulated by solenoid valve, 48. Electrical insulator, 50, attached to first side 14 of end plate 12 supports and electrically isolates metal tube 40 from both end plate 12 and iron core 20. Metallic keeper element, 52, having a hole therein for permitting the chosen gas from metal tube 40 to pass therethrough is electrically isolated from iron core 20 and metal tube 40 by spacer, 54, which also has a hole therein to permit gas from tube 40 to pass therethrough.

Second cylinder, 56, having a third axis collinear with the first axis, includes second cylindrical magnetizable screen, 58, having a fourth axis collinear with the first axis, and an inner diameter which is larger than the outer diameter of first cylindrical magnetic screen 36, forming an annular region, 60, therebetween; second conducting wire coil, 62, disposed around second magnetic screen 58; and magnetizable outer cylinder, 64, having a fifth axis collinear with the first axis surrounding second wire coil 62, outer cylinder 64 having first end, 66, and second end, 68, first end 66 being mounted to end plate 12, and outer surface 69. Second end 68 of outer cylinder 64 is formed into circular pole piece, 70, which faces pole piece 34 formed from the second end of core 20 across annular region 60 (See, e.g., Ioannis G. Mikellides et al., "Magnetic Shielding of a Laboratory Hall Thruster, I. Theory and Validation," Journal of Applied Physics 115, No. 4 (2014): 043303).

At least one cylindrical anode band, 72, is disposed in annular region 60, supported by cylindrical ion channel, 74, formed on both sides of annular region 60, and adapted to electrically insulate first magnetic screen 36 and second magnetic screen 58 from the least one anode band. Ion channel 74 is chamfered or tapered at its downstream or open end such that magnetic field lines follow the shape of the chamfer. The chamfer does not affect the field lines; rather, it is shaped to follow the field lines, since it is known that actual thrusters are eroded to this shape after which further erosion ceases. Ion channel 74 may be made from polycarbonate, polyether ether ketone, PEEK, graphite, boron nitride, or petalite ceramic, as examples. When using insulating channel materials a conductive anode is needed. Shown also in FIG. 1 is a second metal anode band, 76, for purposes of illustration. Gas plenum, 78, is adapted to receive a second chosen gas introduced through inlet, 79, and for distributing the second gas into ion channel 74 from gas source, 80, the flow being controlled by solenoid valve, 82. Gas plenum 78 has a plurality of holes leading to the ion channel that assist in the uniform distribution of gas. Plenum 78 also has additional cavities that serve to distribute the gas from the inlet to the plenum in a manner that ensures the gas pressure within the plenum is as uniform as possible. FIG. 1, being a cross-sectional view, shows only an inlet cavity located downstream of inlet 79, where gas is collected and diverted in the azimuthal direction to enter plenum 78, at locations not shown in FIG. 1. The first chosen gas and the second chosen gas may be the same gas or different gases.

Power supply, 84, provides current to first conducting wire coil 32, and power supply, 86, supplies current to second conducting wire coil 62 for controlling the magnetic fields of the Hall current plasma source. Nonmagnetic thin spool, 88, may be provided to facilitate the winding of the second conducting wire coil. Power supply, 90, provides a selected voltage between anode band 72 and metal tube 40, for controlling the discharge of the Hall current plasma source, while power supply, 92, provides a chosen current for controlling the plasma discharge between the external keeper 52 and the hollow cathode discharge apparatus 38. Hollow cathode discharge apparatus 38, based on the mayenite form of electride material, is described in detail in U.S. Pat. No. 9,305,733, which issued on Apr. 5, 2016, and in U.S. Pat. No. 9,552,952, which issued on Jan. 24, 2017, the entire contents of both patents hereby being specifically incorporated by reference herein for all that they disclose and teach. The '733 and '952 patents describe electride hollow cathodes and instant starting of electride cathodes. As mentioned above, other hollow cathodes can be started instantly and can be used in hollow cathode discharge apparatus 38. However, in what follows, we describe only the electride hollow cathode.

Figure 2A:
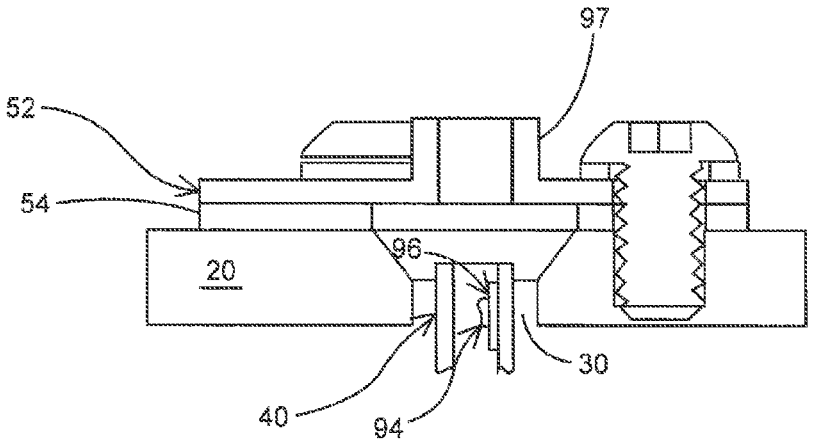
FIGS. 2A and 2B illustrate alternative external keeper geometries for improving neutral confinement and enhancing the plasma bridge that forms between the cathode and the plasma regions downstream.
Figure 2B:
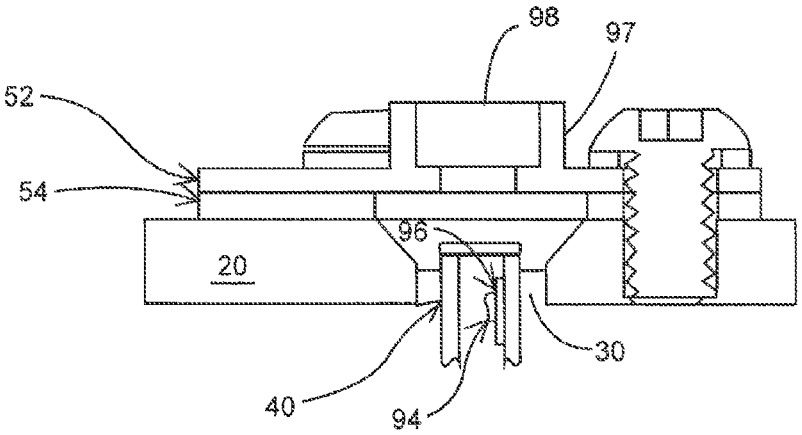

Turning now to FIGS. 2A and 2B, external keeper 52 initiates the operation of hollow cathode apparatus 38, and creates the plasma bridge that connects the low-work-function electride material insert, 94, mounted on a piece of graphite, 96, attached to the inner surface of metal tube 40, to the plasma regions downstream of the external keeper. Other low-work-function material inserts, 94, attached to the inner surface of metal tube 40 can be used, with and without graphite. The hollow cathode operation is initiated by placing a positive voltage to the external keeper plate relative to the cathode voltage and by opening a solenoid valve that allows gas to flow through the cathode tube, through the cathode tube orifice, through the gap between the cathode tube orifice and the external keeper, and finally through the external keeper orifice. With voltage and gas flow, a plasma discharge is produced within the cathode tube in the vicinity of the low work function insert, within the cathode tube orifice, and through the gap between the cathode tube orifice and the external keeper. Electrons flow from the low work function insert through the cathode tube orifice, and through the gap between the cathode orifice plate and the external keeper plate. A portion of the electron current flows from the low work function insert to the external keeper that is typically between 0 A and 1 A and a separate portion of the electron current flows from the low work function insert to plasma regions downstream of the external keeper. The external keeper functions in an analogous manner to a conventional enclosed keeper, but its external location rather than cylindrical geometry eliminates the need to remove iron from the central portion of the Hall current plasma source to make room for an enclosed keeper, which would have a deleterious effect on the generated magnetic field. The external keeper is mounted flush to an insulator washer 54, which ensures that gas flows through the keeper orifice as is the case for an enclosed keeper.

Alternative external keeper designs for improving the utilization of the gas flow directed through the cathode and external keeper are shown. Additional description may be found in the '733 and '952 patents. FIG. 2A illustrates a simple extension of the length of the external keeper orifice plate, while FIG. 2B illustrates an external keeper with an orifice that has a cylindrical region, 98, of slightly larger diameter located on its downstream surface. Reduction of cathode flow improves the overall performance of the Hall current plasma source as a thruster. Furthermore, the implementation of the Hall current plasma source to assist thin film growth is simplified and its impact on vacuum chamber process pressure is reduced when the cathode flow is reduced. The effectiveness of the plasma bridge that forms between the cathode and the plasma regions downstream is degraded, however, when the gas flow is reduced below a minimum value typically in the range of 5% to 10% of the gas flow being directed through the anode for large Hall current plasma sources. For sources having outer diameters smaller than 7 cm, the minimum cathode flow can become as large as 50% of the gas flow being directed through the channel. Although the cathode gas flow is required for cathode operation and plasma bridge function, most of the gas directed through the cathode does not get ionized and very few of the ions that are created are accelerated to significantly high energies. Thus, the plasma source performance is reduced and the vacuum chamber process pressure is degraded by excessive cathode gas flow. The Hall current plasma source can be improved if the neutral gas in the vicinity of the cathode and external keeper could be more effectively utilized. It has been demonstrated that enclosed keepers having cylindrical extension aspect ratios (length to diameter) close to one have improved emission current capability by 3 to 10 times over cathodes with keeper orifices without extensions or related passive neutral confinement techniques. The keeper configurations shown in FIGS. 2A and 2B therefore increase the neutral atom concentration in these regions over those that occur in simple external keepers, and the electrons flowing through the plasma bridge in the regions of higher neutral atom concentration produce more plasma ions, which increases plasma density and reduces the impedance between the cathode and the plasma regions downstream.

Figure 3A:
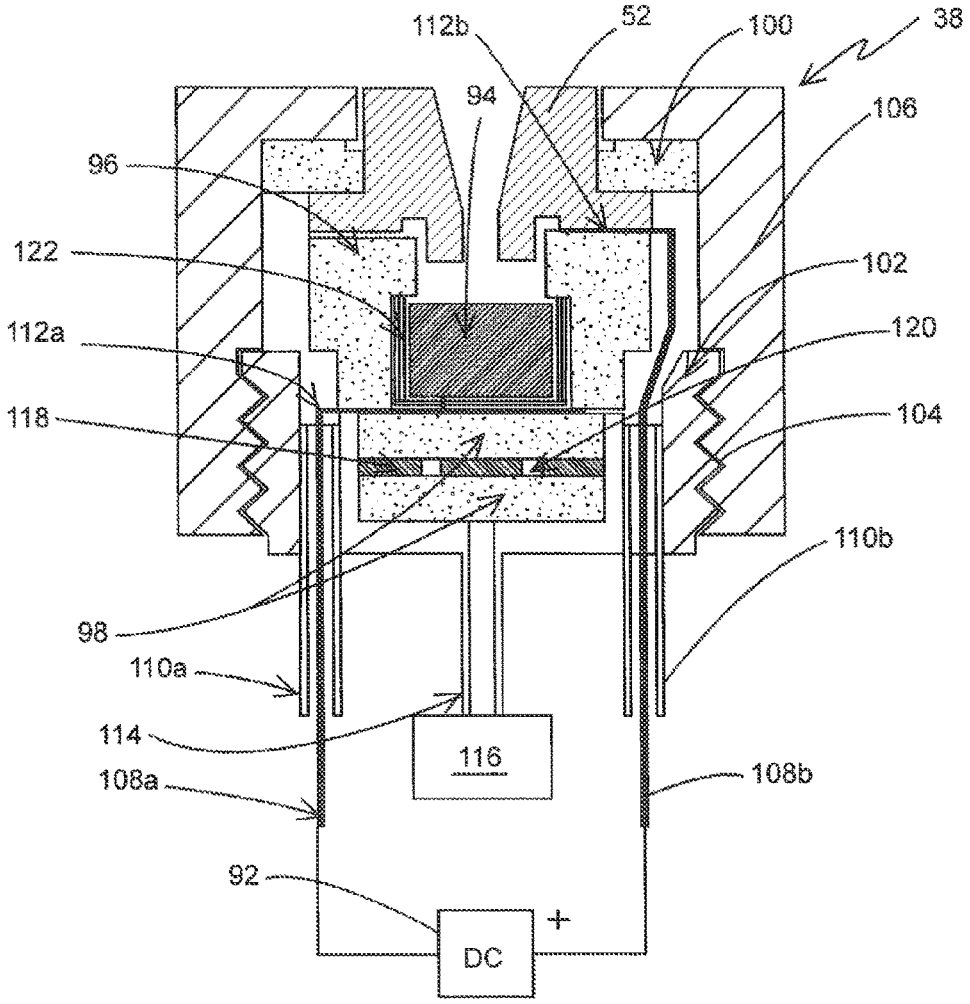

FIG. 3A is a schematic representation of the side view of another embodiment of the hollow cathode apparatus 38 hereof, suitable for external mounting on the top 68 or outside surface 69 of magnetizable outer cylinder 64 of second cylinder 56, or on the top surface 24 of core 20, including disk or puck shaped, low-work function, or other instant start insert material, 94, electrically isolated from the surrounding structure by gas porous insulators, 96, and, 98. Cathode apparatus 38 can be instantly started without the use of a heater through direct application of high voltage from power supply 92 between insert 94 and external keeper 52 that is electrically isolated from insert material 94 by insulators 96 and, 100. In the embodiment shown in FIG. 3, body or base, 102, is threaded, 104, so that cover, 106, can be screwed down to secure the keeper, insulators, insert, and other components within the interior or chamber regions of the cathode assembly 38. The various components may also be secured by other means known in the art. Body 102 and cover 106 may be made from non-magnetic materials such as refractory metals including Ta, W, Mo, and MoRe, as examples. Electrical leads, 108*a*, and, 108*b*, are used to provide electrical connection to insert 94 and keeper 52 using coaxial cable, where metal cable covers, 110*a*, and 110*b*, respectively, are insulated from the electrical leads. One method of accomplishing this is by using swaged, Ta coaxial cable having MgO insulation between the electrical leads and the coaxial cable covers, which is also a coaxial cable construction that is compatible with use at high temperature. The electrical leads are connected to metal electrodes, 112*a* and 112*b*, respectively, for making electrical contact to insert 94 and keeper 52, respectively. Gas is introduced to the externally surface-mounted hollow cathode assembly through tube, 114, from gas source, 116, and the gas flows through porous ceramic 98 that sandwiches metal disk, 118, which has two or more holes, 120, therethrough to allow gas to pass to the insert region through porous gas passageway 96 through and around radiation shielding, 122, comprised of refractory metal foil placed around insert 94 on three sides to thermally isolate the insert from the surrounding ceramic isolators. The number of layers of radiation shielding can be adjusted to achieve the desired level of thermal isolation between the insert and the surrounding ceramic surfaces. Porous ceramic insulator 98 and metal disk 118 integrated into external surface-mounted hollow cathode assembly 38 also serve to electrically isolate insert 94 from body 102 of the assembly. The thickness of the porous ceramic and the metal disk can be adjusted to achieve the desired level of electrical isolation.

Figure 3B:
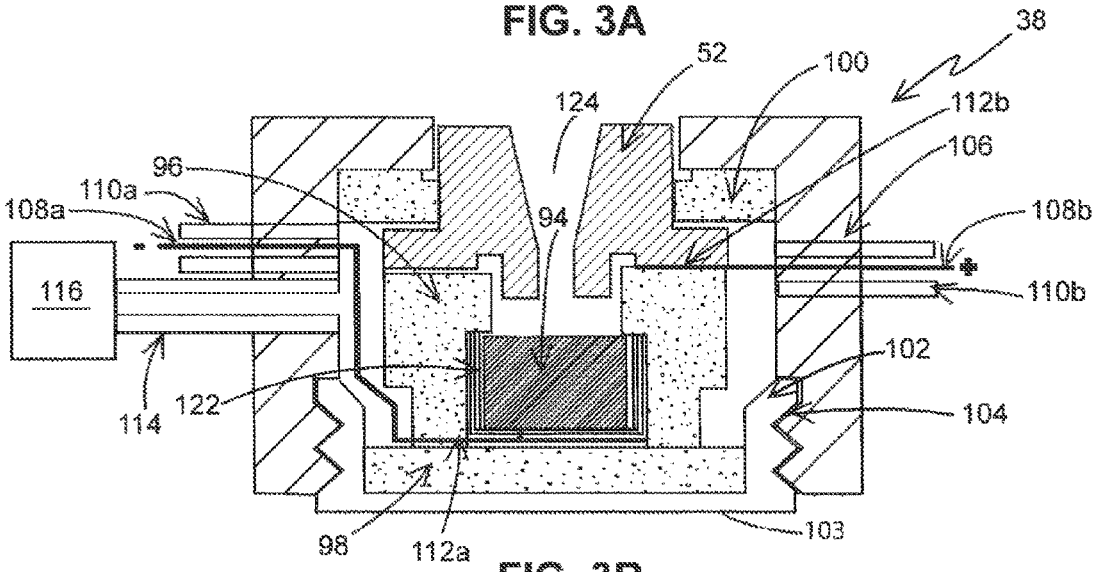
FIG. 3B is a schematic representation of a side view of an embodiment of an external hollow cathode apparatus effective for mounting directly onto the outer top surface of either the inner or outer poles of the cylindrical magnetizable core.

In another embodiment of the hollow cathode apparatus 38 hereof, FIG. 3B is a schematic representation of a side view of a surface mountable hollow cathode apparatus effective for mounting directly on the top 68 or outside surface 69 of magnetizable outer cylinder 64 of second cylinder 56, or on the top surface 24 of core 20, including disk or puck shaped, low-work function, or other instant start insert material, 94, electrically isolated from the surrounding structure by insulators 96 and 98 of FIG. 1. An advantage of direct mounting the cathode on the pole piece is that magnetic core material does not have to be removed from within core 20. FIG. 3B is similar to FIG. 3A except that bottom surface, 103, of body 102 is flat as a result of moving electrical leads 108*a* and 108*b*, metal cable covers 110*a* and 110*b*, gas source 116, and tube, 114, to the side of body 102. Insulator 98 need no longer be porous, and gas introduced through tube 114 reaches insert material 92 through porous insulator 96.

The hollow cathode embodiments 38 illustrated in FIGS. 3A and 3B have cylindrical shape, and are shown having a cylindrical-conical opening, 124, in keeper 52. Alternative configurations are possible where circular, linearly slotted, or slots formed in arcs can be used for the external keeper openings above the insert, and permit the electron emission current capability of a surface-mounted hollow cathode to be controlled. The emission current capability of a hollow cathode is determined by the surface area of the insert and the area of the orifice opening in the keeper for a given maximum specified temperature of the insert and other materials used in the cathode. Arbitrarily high currents will eventually lead to damage for a given insert and keeper geometry. The current capacity can be increased at a given maximum temperature if the area of the insert and the area of the keeper orifice opening is increased.

Figure 4A:
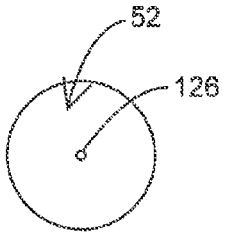
FIGS. 4A, 4B, and 4C are schematic representations of top views of three alternative external keeper orifice openings of circular, linearly slotted, or slots formed on arcs for the external, surface mounted hollow cathode assembly, which provide the capability for setting the electron emission current of a surface-mounted hollow cathode from lower current to higher current.
Figure 4B:
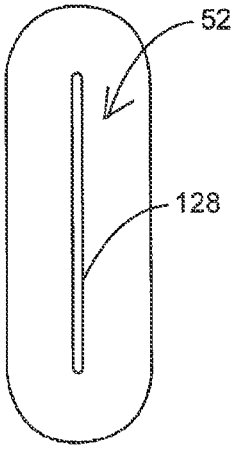
Figure 4C:
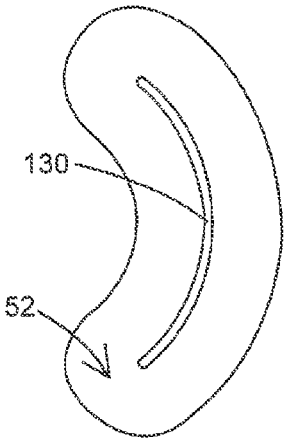

FIGS. 4A, 4B, and 4C illustrate top views of alternative external keeper orifice openings, 130. In FIG. 4A circular external keeper orifice plate, 52, is shown having a circular orifice opening, 126. This plate illustrates the external keeper shown in FIG. 1, without the additional features illustrated in FIGS. 2A, 2B, and 3A. Typical orifice openings range from diameters of 0.01" to 0.1", but can be larger for high current cathodes. To increase current capability while maintaining a customizable form, a slotted keeper opening may be used. FIG. 4B exhibits one embodiment of this where linear-oval external keeper orifice plate, 128, is shown having a linear slot orifice opening. The slot length may be adjusted to set the desired total current capability without adjustment of the narrow dimension of the orifice plate. In this manner, a small orifice width can be combined with a long slot length to achieve the current capability of a much larger, circularly configured keeper orifice. FIG. 4C exhibits another embodiment where an arced-oval orifice plate, 52, is shown with arced slot orifice opening, 130. This embodiment might be useful in an application where a high-current cathode electron source is needed on a plasma source surface that is curved, such as on the downstream faces of Hall current plasma sources that use a multitude of nested channels (See, e.g., Scott J. Hall et al., "Implementation and Initial Validation of a 100-kW Class Nested-Channel Hall Thruster," AIAA 3815 (2014): 28-30).

To initiate operation of the externally surface-mounted cathode assembly, high voltage is applied between the insert and keeper with the positive terminal of power supply, 92, connected to the keeper lead 112*b*, and the negative terminal connected to the insert lead 112*a*, and gas flow is introduced to the gas tube. Either steady gas flow can be applied, or a short gas burst of temporary high gas flow followed by a lower, steady gas flow, can be used to initiate an arc discharge between the insert and keeper. As in the center-mounted hollow cathode assemblies shown in FIGS. 1 and 3A, some fraction of the total current from the insert 94 in FIG. 3B will flow from the insert to the keeper and the remaining fraction will flow from the cathode to the external plasma load of the Hall current plasma source (FIG. 1). As the gas pressure rises in the region between the insert and keeper, an electrical breakdown will occur that will heat the insert and allow the electrical breakdown to transition quickly into a thermionic arc.

Current Hall current plasma sources use one power supply for each of the inner and outer magnet coils, one for the cathode heater, one for the cathode keeper, and one for the thruster anode for a total of five power supplies. The heater power supply provides heater power to raise the temperature of a cathode to a point where it will start. The use of hollow cathode assemblies that can be instantly started in accordance with the teachings of the present invention eliminates the need for a heater power supply. The keeper power supply is used to ignite an arc discharge between the insert and the keeper disposed immediately downstream of the cathode and the insert, and the anode power supply initiates a discharge between the cathode and the anode of the Hall current plasma source. One of the two power supplies (keeper or heater) and the cathode gas flow in a conventional Hall current plasma source must always be "on", but the other could be switched "on" and "off" to pulse the cathode "on" and "off," thereby allowing the Hall current plasma source to be operated in a pulsed, "on" and "off" manner. Use of instant start hollow cathodes permits the keeper-biasing power source to be switched "on" in order to switch the hollow cathode discharge "on." The gas flow may also be switched "off" during the "off" portion of the pulsed Hall current plasma source operation when using an instant-start hollow cathode. The instant start capability of the present hollow cathode assembly, along with other modifications described below enables further simplification of the Hall current plasma source power supply system by reducing the number of power sources to a single DC power source for the cathode, keeper, magnet coils, and anode loads.

Figure 5:
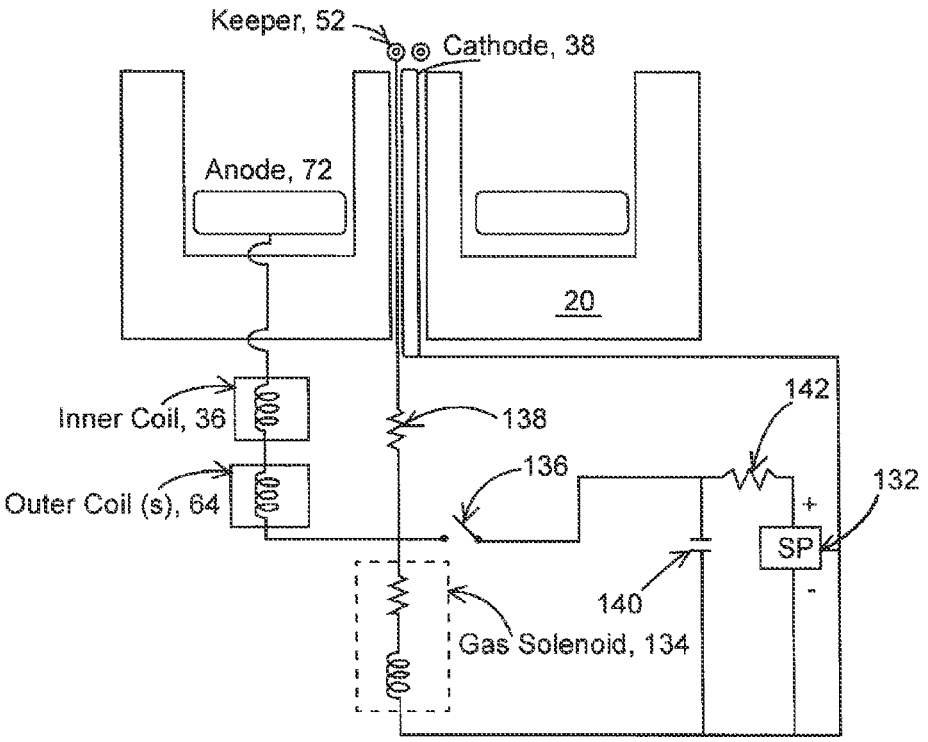
FIG. 5 is an electrical schematic showing how the Hall current plasma source and center- or surface-mounted cathode with external keeper can be operated with a single power source, common switch components, and passive circuit elements.

FIG. 5 shows an electrical schematic of how the Hall current plasma source can be operated in steady state or pulsed "on" and "off" using a single power source, 132 (typically 200 V to 500 V, and 300 mA to 600 mA). Gas solenoid, 134, provides a temporary high flow of gas required to ignite cathode 38 and steady flow after the higher gas burst settles to steady flow by closure of switch, 136.

Additional, parallel, solenoids may be employed, if multiple gases are utilized. Closing this switch also applies voltage to keeper, 52, which, along with the gas flow, results in initiation of the cathode-keeper-anode discharge. Resistor, 138, (which may be between 1 kΩ and 100 kΩ) in the keeper line passively limits the amount of current that flows between the cathode and keeper. The switch and illustrated wiring configuration permits the current flowing from the cathode to the anode to also flow through inner and outer coils, 36 and 64, respectively. A single power supply may control the entire Hall current plasma source operation, significantly reducing the mass and cost of electric propulsion systems for flight applications. Power source, 132, may include a power supply or a solar array. Capacitor, 140, (which may be between 40 g and 120 μF) and resistor, 142, (which may be between 1Ω and 10Ω, or an inductor substituted therefor) may be used to provide a filter to minimize oscillatory interactions between the power source and the Hall current plasma source discharge. Charged by a solar array or other power source, 132, the capacitor provides high voltage directly to the Hall current plasma source, thereby initiating the anode-cathode discharge. This passive element stores energy that can be delivered at a high rate (power level) for triggering or igniting proper startup of the anode discharge.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed:

1. A Hall current plasma source, comprising:

a cylindrical magnetizable core having a first end, a second end, and a first axis, said cylindrical magnetizable core having an outer surface and a channel therethrough between the first end and the second end along the first axis;

a conducting wire coil wound around the outer surface of said cylindrical magnetizable core;

a first cylindrical magnetic screen having a second axis collinear with the first axis enclosing said conducting wire coil, said first cylindrical magnetic screen having an outer diameter;

a hollow cathode discharge apparatus adapted to ionize a first chosen gas, comprising:

a tube disposed in the channel of said cylindrical magnetizable core and electrically insulated from the cylindrical magnetizable core, the tube having a first end and a second end and an inside surface having an insert of low-work-function material attached to the inside surface of said tube, the first end of said tube adapted to receive the first chosen gas; and a keeper element having a hole therethrough for permitting the first chosen gas from said tube to pass therethrough, said keeper element being electrically isolated from said tube;

a second cylindrical magnetic screen having a third axis collinear with the first axis, and an inner diameter which is larger than the outer diameter of said first cylindrical magnetic screen, forming an annular region therebetween;

at least one cylindrical anode band disposed in the annular region;

an annular ion channel having an open end and a closed end formed in the annular region adapted to electrically isolate said first cylindrical magnetic screen and said second cylindrical magnetic screen from said at least one cylindrical anode band; and a gas plenum adapted to receive a second chosen gas and for distributing the second chosen gas into said annular ion channel.

2. The Hall current plasma source of claim 1, further comprising a flat end plate having a first side and an opposing second side, the first end of the cylindrical magnetizable core being attached to the second side of the flat end plate, wherein said flat end plate comprises magnetizable material.

3. The Hall current plasma source of claim 1, wherein said annular ion channel is fabricated from materials chosen from polycarbonate, polyether ether ketone, PEEK, graphite, boron nitride, and petalite ceramic.

4. The Hall current plasma source of claim 1, wherein said low-work-function material comprises $12CaO\text{-}7Al_2O_3$.

5. The Hall current plasma source of claim 1, wherein the first chosen gas and the second chosen gas comprise the same gas.

6. The Hall current plasma source of claim 1, wherein the annular ion channel is tapered such that it is wider toward the open end thereof.

7. A Hall current plasma source, comprising:

a cylindrical magnetizable core having a first end and a second end and a first axis, said cylindrical magnetizable core having an outer surface;

a conducting wire coil wound around the outer surface of said cylindrical magnetizable core;

a first cylindrical magnetic screen having a second axis collinear with the first axis enclosing said conducting wire coil, said first cylindrical magnetic screen having an outer diameter;

a second cylindrical magnetic screen having a third axis collinear with the first axis, and an inner diameter which is larger than the outer diameter of said first cylindrical magnetic screen, forming an annular region therebetween;

at least one cylindrical anode band disposed in the annular region;

an annular ion channel having an open end and a closed end formed in the annular region adapted to electrically isolate said first cylindrical magnetic screen and said second cylindrical magnetic screen from said at least one cylindrical anode band;

a gas plenum adapted to receive a first chosen gas and for distributing the first chosen gas into said annular ion channel; and a hollow cathode discharge apparatus for ionizing a second chosen gas disposed on or above the second end of said cylindrical magnetizable core.

8. The Hall current plasma source of claim 7, wherein the annular ion channel is tapered such that it is wider toward the open end thereof.

9. The Hall current plasma source of claim 7, wherein said hollow cathode discharge apparatus comprises:

a base member having an outside surface and an inside surface, and an inlet therethrough for permitting the second chosen gas to flow;

a low-work function material or cathode instant start material;

an electrical insulator positioned between the inside surface of said base member and said low-work function material and through which the second chosen gas flows around said low-work function material;

a keeper having a hole therethrough through which the second chosen gas flows, and having an outer surface;

second electrical insulator positioned adjacent to at least a portion of the outer surface of said keeper; and a cover member forming a chamber with said base member and having an opening therein facing said low-work function material, said second electrical insulator, said low-work function material, and at least a portion of said keeper positioned in said chamber;

wherein the second chosen gas is flowed around said low-work function material and between said low-work function material and said keeper, and through the hole in said keeper to the outside of said chamber.

10. The Hall current plasma source of claim 9, further comprising radiation shielding surrounding said low-work function material.

11. The Hall current plasma source of claim 9, wherein said low-work function material comprises $12CaO\text{-}7Al_2O_3$.

12. The Hall current plasma source of claim 7, wherein said hollow cathode discharge apparatus comprises:

a base member having an outside surface and an inside surface;

a low-work function material or cathode instant start material;

an electrical insulator positioned between the inside surface of said base member and said low-work function material;

a keeper having a hole therethrough;

second electrically insulating material covering at least a portion of the outer surface of said keeper; and a cover member having an inlet therethrough for permitting the second chosen gas to flow, forming a chamber with said base member, and having an opening therein facing said low-work function material, said second electrical insulator, said low-work function material, and at least a portion of said keeper positioned in said chamber;

wherein the second chosen gas is flowed around said low-work function material and between said low-work function material and said keeper, and through the hole in said keeper to the outside of said chamber.

13. The Hall current plasma source of claim 12, further comprising radiation shielding surrounding said low-work function material.

14. The Hall current plasma source of claim 12, wherein the low-work function material comprises $12CaO\text{-}7Al_2O_3$.

15. A Hall current plasma source, comprising:

a cylindrical magnetizable core having an outer surface and a first axis;

a conducting wire coil wound around the outer surface of said cylindrical magnetizable core;

a first cylindrical magnetic screen having a second axis collinear with the first axis enclosing said conducting wire coil, said first cylindrical magnetic screen having an outer diameter;

a second cylindrical magnetic screen having a third axis collinear with the first axis, and an inner diameter which is larger than the outer diameter of said first cylindrical magnetic screen, forming an annular region therebetween;

at least one cylindrical anode band disposed in the annular region, and in series electrical connection with said conducting wire coil;

a keeper;

a solenoid operated gas valve;

a single electrical power supply having a positive terminal and a negative terminal;

an electrical switch in series electrical connection with said conducting wire coil not in series electrical connection with said at least one cylindrical anode band, said keeper through a resistive element, said solenoid of said gas valve, and in series electrical connection with the positive terminal of said single electrical power supply;

a cathode in series electrical communication with the negative terminal of said single electrical power supply; and a capacitor in parallel electrical connection with the single electrical power supply, an impedance element electrically coupled between a first terminal of the capacitor and the positive terminal of the single electrical power supply, wherein the first terminal of the capacitor is electrically coupled to the electrical switch and the positive terminal of the single electrical power supply is electrically coupled through the impedance element to the electrical switch.

16. The Hall current plasma source of claim 15, wherein said single electrical power supply comprises a solar panel.

17. The Hall current plasma source of claim 15, wherein said capacitor, once charged, is effective for initiating a discharge between said anode and said metal cathode.

18. The Hall current plasma source of claim 15, further comprising at least one additional solenoid operated gas valve in parallel with said solenoid operated gas valve.

19. The Hall current plasma source of claim 15, wherein said cathode comprises a tube containing a low-work function electride material.

20. The Hall current plasma source of claim 19, wherein said low-work-function electride material comprises $12CaO\text{-}7Al_2O_3$.

* * * * *